United States Patent [19]

Finch

[11] 4,222,861

[45] * Sep. 16, 1980

[54] TREATMENT AND RECOVERY OF LARGER PARTICLES OF FINE OXIDIZED COAL

[75] Inventor: Robert E. Finch, Naperville, Ill.

[73] Assignee: Nalco Chemical Company, Oak Brook, Ill.

[ * ] Notice: The portion of the term of this patent subsequent to Jul. 31, 1996, has been disclaimed.

[21] Appl. No.: 913,974

[22] Filed: Jun. 8, 1978

Related U.S. Application Data

[63] Continuation-in-part of Ser. No. 807,770, Jun. 20, 1977, abandoned, which is a continuation-in-part of Ser. No. 696,460, Jun. 16, 1976, abandoned, and a continuation-in-part of Ser. No. 862,942, Dec. 21, 1977, abandoned.

[51] Int. Cl.[2] ..... B03D 1/02

[52] U.S. Cl. ..... 209/166

[58] Field of Search ..... 209/5, 166, 167; 252/61, 9; 210/54 R, 54 A

[56] References Cited

U.S. PATENT DOCUMENTS

| | | | |
|---|---|---|---|
| 3,284,393 | 11/1966 | Vanderhoff | 526/911 X |
| 3,493,501 | 2/1970 | Eck | 210/54 R |
| 3,624,019 | 11/1971 | Anderson | 260/29.6 H |
| 3,734,873 | 5/1973 | Anderson | 260/29.6 H |
| 3,850,618 | 12/1974 | Herbert | 209/5 |
| 3,919,080 | 11/1975 | Staute | 209/167 |
| 3,997,492 | 12/1976 | Kool | 260/29.6 MM |
| 4,024,216 | 5/1977 | Finch | 210/54 A |

FOREIGN PATENT DOCUMENTS

| | | | |
|---|---|---|---|
| 1002702 | 2/1957 | Fed. Rep. of Germany | 209/166 |
| 1004442 | 9/1957 | Fed. Rep. of Germany | 209/166 |
| 203922 | 2/1931 | France | 209/166 |
| 703853 | 8/1962 | United Kingdom | 207/5 |
| 121385 | 6/1958 | U.S.S.R. | 252/61 |

OTHER PUBLICATIONS

Chem. & Tech. of Coal, Aposhis, Published for U.S. Dept. of Int. & NSF by Isiuel Pavgrsn for Sci. Translations, 1966, pp. 33–43.

*Primary Examiner*—Robert Halper

*Attorney, Agent, or Firm*—John G. Premo; Robert A. Miller; John S. Roberts

[57] ABSTRACT

This invention relates to a method and treating agent for increasing the yield of larger particles of fine oxidized coal where the particle size is 28×100 mesh and preferably 28×70 mesh and where said coal particles are concentrated by froth flotation. The method consists of utilizing as a promoter an alkali metal or ammonium polyacrylate. A preferred promoter is about 0.05–1.5 lbs of sodium polyacrylate latex per ton of dry coal (0.017–0.5 lb of dry sodium polyacrylate per ton of dry coal), having an average molecular weight of about 100,000, to 1,000,000 and more, with a preferred range of 1,000,000 or more.

This preferred promoter or frothing aid for oxidized coal is a water-in-oil latex of sodium polyacrylate used with a water-in-oil emulsifier and preferably used with an alcohol-type frother. The latex may be utilized neat and self inverts with the assistance of an oil-in-water surfactant and the water in the system upon application to form an oil-in-water emulsion, or it may be used as a two part system with an activator (aqueous) to promote inversion. Additionally, the latex emulsion recovers larger particles in the size 100 mesh and greater and preferably in the range 28×70 mesh.

5 Claims, No Drawings

TREATMENT AND RECOVERY OF LARGER PARTICLES OF FINE OXIDIZED COAL

This application is a continuation in part of U.S. Ser. No. 807,770 filed June 20, 1977, by Robert E. Finch, now abandoned, and entitled "Flotation of Oxidized Coal with a Latex Emulsion of Sodium Polyacrylate Used as a Promoter," which is a continuation in part of Ser. No. 696,460 filed June 16, 1976, by Robert E. Finch, now abandoned, and is also a continuation in part of Ser. No. 862,942 filed Dec. 21, 1977, by Robert E. Finch, now abandoned.

Supplemental to the Finch development noted above, it has been found that in the treatment of fine oxidized coal, the utilization of the treatment agent in a mixture enables a greatly heightened recovery in the particle size 28×100 mesh and preferably 28×70 mesh, utilizing the Tyler equivalent designation, the U.S. Sieve Series, ASTM-E-11-61 (Perry et al, *Chemical Engineers Handbook*, 5th Edition, 1973, page 21–41).

The present invention relates to a method of increasing the yield of oxidized coal in the range 28×100 mesh where said coal or coal particles are subjected to concentrations by froth flotation.

Coal generally is mined in this country and elsewhere from two different sources. A first source of great importance to retrieval of coal presently is coal mined from so-called strip mines where the coal is near or at the surface of the ground and the veins are stripped therefrom. During this stripping process and before the coal is actually retrieved, the surface veins of coal are subjected to a significant amount of air oxidation which apparently changes the characteristics of the particles so that the results obtained in a concentration by froth flotation are different from concentration of the coal from the other source which is mined underground generally at a depth of greater than 100 feet from the surface and where there is less oxidation as in the underground mines of Pennsylvania and West Virginia.

The term "oxidized coal" in the present invention is defined as any type of weathered coal such a strip mined coal or native or deep mined coal in which there has been a 1% or greater increase in oxygen content due to weathering, stockpiling, long storage times, etc. The different degrees of weathering in coal seams as to oxygen content is highly variable and the following analysis is taken from Karaganda coals (Russian) and is cited from A. A. Agroskin, *Chemistry and Technology of Coal*, 1966, page 33, translated by the Israel Program for Scientific Translations 1966:

| | |
|---|---|
| Carbon | 77.9–88.3% |
| Hydrogen | 4.2– 5.7% |
| Nitrogen | 1.0– 1.7% |
| Oxygen | 5.2–16.2% |

The deleterious effect of an increase of oxygen in coal has been noted by several authors, e.g., S. C. Sun, *Coal Preparation*, "Part 3. Froth Flotation," page 10–67, "The unfloatability of oxygen and mineral matter is indicated by the nonfloatable lignite and animal charcoal. The deleterious effect of oxygen on the floatability of coals and coke has been described . . . ."

It is further noted that coal is readily oxidized in air and this process sometimes even gives rise to spontaneous combustion in the coal and results in weathering or loss of calorific value and coking power during storage in the open.

As is known, flotation is a process for separating finely ground minerals such as coal particles from their associate waste or gangue by means of the affinity of surfaces of these particles for air bubbles, which is a method for concentrating coal particles. In the flotation process a hydrophobic coating is placed on the particles which acts as a bridge so that the particles may attach to the air bubble and be floated, since the air bubble will not normally adhere to a clean mineral surface such as coal.

In froth flotation of coal a froth is formed as aforesaid by introducing air into a so-called pulp which contains the impure finely divided coal particles and water containing a frothing agent. The flotation separation of coal from the residue or gangue depends upon the relative wettability of surfaces and the contact angle, which is the angle created by the solid air bubble interface.

In the development of flotation to date, three general classes of reagents have been utilized: (1) collectors or promoters, (2) modifiers, and (3) frothers.

The collectors may be selected from such compounds, among others, as primary amines, quaternary ammonium salts, xanthates, fatty acid soaps, alkyl sulfates, etc. A typical listing of commercial collectors is given in Kirk-Othmer, *Encyclopedia of Chemical Technology*, II, Vol. 9, page 384, Table 2.

Modifiers are such regulating agents as pH regulators, activators, depressants, dispersants, and flocculants.

A frothing agent is utilized to provide a stable flotation froth persistent enough to facilitate the coal separation but not so persistent that it cannot be broken to allow subsequent handling. Examples of commonly used frothing agents are pine oil, creosote, cresylic acid, and alcohols such as 4-methyl-2-pentanol. Alcohol frothers are preferred in the present invention and additional alcohols are illustrated by amyl and butyl alcohols, terpeneol and cresols. An additional preferred alcohol is methyl isobutylcarbinol (MIBC), which is an aliphatic alcohol in common use as a frother.

The present treating agents which are water-soluble polyacrylates are useful as promoters and frothing aids.

PRIOR ART STATEMENT

A. Utilization of water-soluble polymers.

U.S. Pat. No. 2,740,522 Aimone et al—The patentee utilizes water-soluble polymers in amounts 0.001 lbs/ton to 1.0 lbs/ton with a preferred amount of 0.01 lbs/ton to 0.2 lbs/ton. Example 16 (column 7) shows the flotation of Pennsylvania anthracite coal fines conditioned with 0.2 lbs/ton of the sodium salt of hydrolyzed polyacrylonitrile to produce a rougher concentrate. A second portion of the example utilizes 0.5 lbs/ton of polymer. This patent appears equivalent to British Pat. No. 749,213.

B. Concentration of coal by flotation:

U.S. Pat. No. 3,696,923 Miller

In the above prior art, none of the patents noted dealt with the problems envisaged with the attempts to use flotation concentration on oxidized coal.

It was found that in attempting to float oxidized coal there were serious problems of flooding, stoppages of equipment, and unsatisfactory yield and this was true where a majority blend of deep mine coal was mixed with strip coal where 80% deep mine coal was utilized in the mixture.

THE TREATING AGENT

The treating agent for the present invention may be defined as a promoter which is a latex or water-in-oil emulsion of a water-soluble anionic linear addition polymer of a polymerizable monoethylinically unsaturated compound having an average molecular weight of about 100,000 to 1,000,000 and more, with a preferred molecular weight of about 1,000,000 or more.

A specially preferred promoter is an alkali metal polyacrylate such as sodium polyacrylate or potassium or ammonium polyacrylate. The sodium salt is specially preferred. The dosage of this latter treating agent is in the range of 0.05–1.5 lbs of sodium polyacrylate latex per ton of dry coal (0.017–0.5 lb of dry sodium polyacrylate per ton of dry coal) and it is utilized conventionally as a 0.5–2% solution. The addition of the water-in-oil emulsion in the amount of 0.3 lb/ton of dry coal enhanced the recovery of larger coal particles by flotation from 10–12% to 68–90%.

THE PROBLEM OF FLOTATION IN THE LARGER PARTICLES OF FINE OXIDIZED COAL

In the concentration and flotation of fine particles of oxidized coal, it was known that great difficulty occurred in floating the larger fine particles in the areas of 28×70 mesh (Tyler equivalent designation—U.S. Sieve Series, ASTM E-11-61). In the present invention, it was discovered that the utilization of an emulsion latex of sodium polyacrylate as a treating agent in specified treatment dosages resulted in a very unusual increase in recovery of the larger fine particles. The prior art has shown that, in a given size range of raw coal, there is an inverse relationship between particle specific gravity and particle floatability. Among the factors for this relationship are the following: (1) the organic components of coal, which are the components most amenable to bubble attachment, are lowest in specific gravity and (2) the inorganic components, which resist bubble attachment, are all higher in specific gravity than the organic components. In particles composed of mixtures of organic and inorganic components, the floatability generally decreases as the inorganic matter of the particles increases.

Particle floatability can therefore be thought of in terms of both particle mass and the coal surface available for bubble attachment and can be expressed by the following relationship:

$$F \propto \frac{f(S)}{g(M)}$$

where

F=particle flotability f(S)=a function of particle coal surface g(M)=a function of the particle mass M=particle mass=specific gravity 0.52 $D^3$ This expression shows that particle floatability F increases with an increase in the coal surface S and with a decrease in particle mass M.

Any flotation process achieves separations because of differences in particle surface properties. Coal flotation is possible because bubbles attach to coal but not to mineral matter and occurs when enough air bubbles have attached to the coal portion of a particle to lower the specific gravity of the particle-bubble combination below that of water. Consequently, the amount of air needed to float particles in a given size range increases as particle specific gravity increases.

In FIG. 1 and Table 1 laboratory flotation tests using the present treating agent, sodium polyacrylate, in a water-in-oil emulsion used at various dosages followed by subsequent screen analysis indicate significant improvement in coal recovery of the 28×100 mesh particle size for oxidized coal. It was further found that recovery of oxidized coal in the 28×70 particle size without this treating agent is often as low as 10–11%; however, with 0.3 lb/ton of sodium polyacrylate latex recoveries increased to 90%.

TABLE 1

SIEVE ANALYSIS DATA - OXIDIZED COAL

| Sieve Size | Wt % | % Ash | Volatiles (gm) | Percent Recovery* |
|---|---|---|---|---|
| Raw Feed Coal | | | | |
| 28 × 35 | 6.4 | 22.8 | 14.8 | NA |
| 35 × 70 | 40.4 | 18.4 | 98.9 | NA |
| 70 × 100 | 13.6 | 15.9 | 34.3 | NA |
| 100 × 140 | 7.8 | 15.0 | 19.9 | NA |
| 140 × 200 | 8.2 | 15.4 | 20.8 | NA |
| 200 × 270 | 4.8 | 16.0 | 12.1 | NA |
| 270 × 325 | 3.0 | 15.8 | 7.6 | NA |
| −325 | 15.7 | 23.0 | 36.3 | NA |
| MIBC-Type Frother (0.1#/ton), Fuel Oil (0.4#/ton) | | | | |
| Clean Coal Concentrate | | | | |
| 28 × 35 | 1.7 | 4.4 | 1.8 | 11.8 |
| 35 × 70 | 9.5 | 5.8 | 9.7 | 9.8 |
| 70 × 100 | 21.0 | 6.7 | 21.2 | 61.7 |
| 100 × 140 | 13.7 | 6.8 | 13.8 | 69.3 |
| 140 × 200 | 13.4 | 6.8 | 13.5 | 64.8 |
| 200 × 270 | 8.0 | 7.0 | 8.0 | 66.5 |
| 270 × 325 | 4.5 | 7.1 | 4.5 | 59.5 |
| −325 | 28.1 | 10.1 | 27.3 | 75.2 |
| MIBC-Type Frother (0.1#/ton), Fuel Oil (0.4#/ton, Sodium Polyacrylate Emulsion (0.075#/ton) | | | | |
| Clean Coal Concentrate | | | | |
| 28 × 35 | 1.1 | 5.3 | 1.5 | 9.8 |
| 35 × 70 | 35.0 | 7.1 | 45.5 | 46.0 |
| 70 × 100 | 17.3 | 8.0 | 22.3 | 64.9 |
| 100 × 140 | 12.4 | 8.0 | 16.0 | 80.3 |
| 140 × 200 | 9.9 | 8.0 | 12.7 | 61.3 |
| 200 × 270 | 5.0 | 8.1 | 6.1 | 53.2 |
| 270 × 325 | 3.3 | 8.3 | 4.2 | 55.9 |
| −325 | 16.0 | 11.6 | 19.8 | 54.6 |
| MIBC-Type Frother (0.1#/ton), Fuel Oil (0.4#/ton), Sodium Polyacrylate Emulsion (0.15#/ton) | | | | |
| Clean Coal Concentrate | | | | |
| 28 × 35 | 2.6 | 5.7 | 4.4 | 29.5 |
| 35 × 70 | 39.4 | 7.7 | 64.7 | 65.4 |
| 70 × 100 | 15.5 | 9.0 | 25.1 | 73.2 |
| 100 × 140 | 10.5 | 9.0 | 17.0 | 85.5 |
| 140 × 200 | 8.8 | 9.1 | 14.2 | 68.4 |
| 200 × 270 | 4.6 | 9.7 | 7.4 | 61.1 |
| 270 × 325 | 2.8 | 10.4 | 4.5 | 58.9 |
| −325 | 15.8 | 17.0 | 23.3 | 64.4 |
| MIBC-Type Frother (0.1#/ton), Fuel Oil (0.4#/ton), Sodium Polyacrylate Emulsion (0.30#/ton) | | | | |
| Clean Coal Concentrate | | | | |
| 28 × 35 | 4.4 | 6.7 | 10.2 | 68.7 |
| 35 × 70 | 39.5 | 8.6 | 89.5 | 90.5 |
| 70 × 100 | 14.6 | 10.1 | 32.6 | 94.9 |
| 100 × 140 | 9.0 | 10.8 | 19.9 | 100 |
| 140 × 200 | 9.3 | 12.5 | 20.2 | 96.9 |
| 200 × 270 | 4.9 | 13.4 | 10.3 | 86.9 |
| 270 × 325 | 3.2 | 14.4 | 6.8 | 89.6 |
| −325 | 15.2 | 18.9 | 30.6 | 84.3 |

*Based on Raw Feed Coal

GENERALIZED STATEMENT AS TO WATER-IN-OIL EMULSIONS OF WATER-SOLUBLE VINYL ADDITION POLYMERS

The water-in-oil emulsions of water-soluble vinyl addition polymers useful in this invention contain four basic components. These components and their weight percentages in the emulsions are listed below:

A. Water-soluble sodium polyacrylate
   1. Generally from 5–60%
   2. Preferably from 20–40%
   3. Most preferably from 25–35%

B. Water
   1. Generally from 20–90%
   2. Preferably from 20–70%
   3. Most preferably from 30–55%

C. Hydrophobic liquid
   1. Generally from 5–75%
   2. Preferably from 5–40%
   3. Most preferably from 20–30%

D. Water-in-oil emulsifying agent
   1. Generally from 0.1–21%
   2. Preferably from 1–15%
   3. Most preferably from 1.2–10%

It is also possible to further characterize the water-in-oil emulsions of water-soluble vinyl addition polymers with respect to the aqueous phase of the emulsions. This aqueous phase is generally defined as the sum of the polymer or copolymer present in the emulsion plus the amount of water present in the emulsion. This terminology may also be utilized in describing the water-in-oil emulsions which are useful in this invention. Utilizing this terminology, the aqueous phase of the water-in-oil emulsions of this invention generally consists of 25–95% by weight of the emulsion. Preferably, the aqueous phase is between 60–90% and most preferably from 65–85% by weight of the emulsion.

The emulsions also may be characterized in relation to the water/oil ratios. This figure is simply a ratio of the amount of water present in the emulsion divided by the amount of hydrophobic liquid present in the emulsion. Generally, the water-in-oil emulsions of this invention will have a water/oil ratio of from 0.25 to 18. Preferably, the water-in-oil ratio will range from 0.5–14, and most preferably from 1.0–2.75.

THE WATER-SOLUBLE VINYL ADDITION POLYMERS

The water-soluble vinyl addition polymer utilized was linear sodium polyacrylate having an average molecular weight of about 100,000 to 1,000,000 and more, with a preferred range of 1,000,000 or more.

THE HYDROPHOBIC LIQUIDS

The hydrophobic liquids or oils used in preparing these emulsions may be selected from a large group of organic liquids which include liquid hydrocarbons and substituted liquid hydrocarbons.

A preferred group of organic liquids that can be utilized in the practice of this invention are paraffinic hydrocarbon oils. Examples of these types of materials include a branch-chain isoparaffinic solvent sold by Humble Oil and Refinery Company under the tradename "Isopar M" described in U.S. Pat. No. 3,624,019 and a paraffinic solvent sold by the Exxon Company, U.S.A. called "Low Odor Paraffinic Solvent." Typical specifications of this material are set forth below in Table 2.

TABLE 2

| | |
|---|---|
| Specific Gravity 60°/60° F. | 0.780–0.806 |
| Color, Saybolt | + 30 min. |
| Appearance, visual | Bright and Clear |
| Aniline Point, °F., Astm D-611 | 160 min. |
| Distillation, °F., ASTM D-86 | |
| IBP | 365 min. |
| FBP | 505 max. |
| Flash Point, °F., TCC | 140 min. |
| Sulfur, ppm, Microcoulometer | 15 max. |

While paraffinic oils are the preferred materials for use in preparing the water-in-oil emulsions of this invention, other organic liquids can be utilized. Thus, mineral oils, kerosenes, naphthas, and in certain instances petroleum may be used. While useful in this invention, solvents such as benzene, xylene, toluene, and other water-immiscible hydrocarbons having low flash points or toxic properties are generally avoided due to problems associated with their handling.

THE WATER-IN-OIL EMULSIFYING AGENTS

Any conventional water-in-oil emulsifying agent can be used such as sorbitan monostearate, sorbitan monooleate, and the so-called low HLB materials which are all documented in the literature and are summarized in the Atlas HLB Surfactants Selector. Although the mentioned emulsifiers are used in producing good water-in-oil emulsions, other surfactants may be used as long as they are capable of producing these emulsions. It is also contemplated, however, that other water-in-oil emulsifying agents can be utilized.

U.S. Pat. No. 3,997,492 shows the use of emulsifiers generally having higher HLB values to produce stable emulsions similar in character to those discussed above. With the use of the equations present in this reference, which is hereinafter incorporated by reference, emulsifiers having HLB values between 4–9 can be utilized in the practice of this invention.

In addition to the reference described above, U.S. Pat. No. 4,024,097 discloses particular emulsifying agents for the water-in-oil emulsions, which are the subject of this invention. These emulsions are generally prepared according to this reference utilizing a water-in-oil emulsifying agent comprising a partially esterified lower N,N-dialkanol substituted fatty amide. Additionally, other surfactants may be combined to produce emulsions having small particle sizes and excellent storage stability.

THE PREPARATION OF THE WATER-IN-OIL POLYMERS OF WATER-SOLUBLE VINYL ADDITION POLYMERS

The general method for the preparation of emulsions of the type described above is contained in Vanderhoff, U.S. Pat. No. 3,284,393, which is hereinafter incorporated by reference. A typical procedure for preparing water-in-oil emulsions of this type includes preparing an aqueous solution of a water-insoluble vinyl addition monomer and adding this solution to one of the hydrocarbon oils described above. With the addition of a suitable water-in-oil emulsifying agent and under agitation, the emulsions is then subjected to free radical polymerization conditions and a water-in-oil emulsion of the water-soluble vinyl addition polymer is obtained. It should be pointed out that the ingredients are chosen based upon the weight percentages given above and their compatability with each other. As to choice of free radical catalyst, these materials may be either oil or water soluble and may be from the group consisting of organic peroxides, Vazo type materials, red-ox type initiator systems, etc. Additionally, ultraviolet light, microwaves, etc., will also cause the polymerization of water-in-oil emulsions of this type.

In the manufacture of emulsions of this type, which are further detailed in U.S. Pat. No. 3,624,019, Reissue No. 28,474, U.S. Pat. No. 3,734,873, Reissue No. 28,576, U.S. Pat. No. 3,826,771, all of which are hereinafter incorporated by reference, the use of air may be employed to control polymerization. This technique is described in U.S. Pat. No. 3,767,629 which is also hereinafter incorporated by reference.

In addition to the above references, U.S. Pat. No. 3,996,180 describes the preparation of water-in-oil emulsions of the types utilized in this invention by first forming an emulsion containing small particle size droplets between the oil, water, monomer and water-in-oil emulsifying agent utilizing a high shear mixing technique followed by subjecting this emulsion to free radical polymerization conditions. Also of interest is U.S. Pat. No. 4,024,097 which describes water-in-oil emulsions such as those described above utilizing particular surfactant systems for the water-in-oil emulsifying agent, allowing for the preparation of latexes having small polymer particle sizes and improved storage stability.

Another reference, U.S. Pat. No. 3,915,920, discloses stabilizing water-in-oil emulsions of the type above described utilizing various oil-soluble polymers such as polyisobutylene. Employment of techniques of this type provides for superior stabilized emulsions.

Of still further interest is U.S. Pat. No. 3,997,492 which describes the formation of water-in-oil emulsions of the type above described utilizing emulsifiers having HLB values of between 4–9.

PHYSICAL PROPERTIES OF THE WATER-IN-OIL EMULSIONS

The water-in-oil emulsions of the finely divided water-soluble polymers useful in this invention contain relatively large amounts of polymer. The polymers dispersed in the emulsion are quite stable when the particle size of the polymer is from the range of 0.1 micron up to about 5 microns. The preferred particle size is generally within the range of 0.2 micron to about 3 microns. A most preferred particle size is generally within the range of 0.2 to 2.0 microns.

The emulsions prepared having the above composition generally have a viscosity in the range of from 50 to 1000 cps. It will be seen, however, that the viscosity of these emulsions can be affected greatly by increasing or decreasing the polymer content, oil content, or water content as well as the choice of a suitable water-in-oil emulsifier.

Another factor attributing to the viscosity of these types of emulsions is the particle size of the polymer which is dispersed in the discontinuous aqueous phase. Generally, the smaller the particle obtained, the less viscous the emulsion. At any rate, it will be readily apparent to those skilled in the art as to how the viscosity of these types of materials can be altered. It will be seen that all that is important in this invention is the fact that the emulsion be somewhat fluid; i.e., pumpable.

THE INVERSION OF THE WATER-IN-OIL EMULSIONS OF THE WATER-SOLUBLE VINYL ADDITION POLYMERS

The water-in-oil emulsions of the water-soluble polymers discussed above have unique ability to rapidly invert when added to aqueous solution in the presence of an inverting agent or physical stress. Upon inversion, the emulsion releases the polymer into water in a very short period of time when compared to the length of time required to dissolve a solid form of the polymer. This inversion technique is described in U.S. Pat. No. 3,624,019, hereinafter incorporated by reference. As stated in the Anderson reference, the polymer-containing emulsions may be inverted by any number of means. The most convenient means resides in the use of a surfactant added to either the polymer-containing emulsion or the water into which it is to be placed. The placement of a surfactant into the water causes the emulsion to rapidly invert and release the polymer in the form of an aqueous solution. When this technique is used to invert the polymer-containing emulsion, the amount of surfactant present in the water may vary over a range of 0.01 to 50 percent based on the polymer. Good inversion often occurs within the range of 1.0–10 percent based on polymer.

The preferred surfactants utilized to cause the inversion of the water-in-oil emulsion of this invention when the emulsion is added to water are hydrophilic and are further characterised as being water soluble. Any hydrophilic type surfactant such as ethoxylated nonyl phenols, ethoxylated nonyl phenol formaldehyde resins, dioctyl esters of sodium succinate and octyl phenol polyethoxy ethanols, etc., can be used. Preferred surfactants are generally nonyl phenols which have been ethoxylated with between 8–15 moles of ethylene oxide. A more complete list of surfactants used to invert the emulsion are found in Anderson, U.S. Pat. No. 3,624,019 at columns 4 and 5, and furthermore may be selected from the following:

(1) Surfonic N-95 (Jefferson Chemical Co.), a nonylphenol with 10 moles ethylene oxide (2) Triton N-101 (Rohm & Haas), nonylphenoxy polyethoxyethanol (3) Makon 10 (Stepan Chemical Co.), alkyl phenoxy polyoxyethylene ethanol (4) Igepal CO 630 (GAF), nonylphenoxy poly(ethyleneoxy)ethanol.

Also operable in the present invention, together with the anionic sodium polyacrylate, and as additives are minor percentages of the non-anionic sodium polyacrylamide in the form of a mixture or copolymer wherein the percentile of polyacrylamide is up to 25% of the total. Such addition of polyacrylamide does not modify the basic anionic character of the polymer, which is a necessary criteria but does not add effectiveness to the treating agent.

A specific monomer starting material useful as a promoter for oxidized coal has a composition as follows:

| | |
|---|---|
| Water | 27.0 |
| Caustic soda (50%) | 23.0 |
| Acid acrylic glacial | 20.9 |
| Low odor paraffin solvent (LOPS) | 19.3 |
| Sorbitan monooleate (SPAN 80, ICI) | 1.0 |
| Azo-bis-isobutyronitrile | |

-continued

| | |
|---|---|
| (catalyst) | 0.03 |
| Espesol 3-E (a liquid aromatic hydrocarbon blend, Charter International) | 8.5 |
| Polyisobutylene (stabilizer) | 0.27 |
| Aluminum tristearate (stabilizer) | 0.0002 |

It is noted that, whereas in general a hydrophobic may be utilized, a preferred solvent is paraffinic solvent, such as Low Odor Paraffin Solvent (LOPS) to which may be added a liquid hydrocarbon such as Espesol 3-E.

EXAMPLE 1

A sodium polyacrylate latex emulsion was fed into the flotation cell feed carrying oxidized coal. The latex promoted the flotation of fine coal resulting in increased fine coal recovery up to and including a 64% recovery rate. This sodium polyacrylate latex emulsion coal promoter thus proved effective in increasing recovery of oxidized coal. In use, dosage rates of the sodium polyacrylate latex emulsion varied from approximately 0.3–1.5 lbs of sodium polyacrylate latex per ton of dry coal fed to the flotation circuit. The latex was used in conjunction with a straight chain alcohol frother of the $C_6$–$C_{12}$ type. The alcohol frother dosage was approximately 0.15 lb/ton of dry coal feed. The frother was normally fed to the flotation cell head box.

EXAMPLE 2

Laboratory flotation tests using the present emulsion of sodium polyacrylate showed significant improvement in coal recovery, especially in the 28×70 mesh particle size and also improvement in the 70×100 mesh size. See FIG. 1 and Table 1 above.

As to the effect of sodium polyacrylate, the primary effects appear to be coal surface modification by absorption and enhanced air/air or air/coal flocculation. Absorption of sodium polyacrylate on the surface of oxidized coal, it is believed, renders the hydrophilic surface more hydrophobic and therefore more amenable towards bubble attachment. Sodium polyacrylate may act as an air/air flocculant and as an air/coal flocculant increasing the probability of air/coal absorption. The affinity of sodium polyacrylate is much greater for oxidized coal than for deep mined coal.

I claim:

1. A method of increasing the yield of oxidized coal in the range 28×100 mesh (Tyler) undergoing a concentration treatment of froth flotation by using as a flotation promoter an invertible water-in-oil emulsion of sodium polyacrylate in a dosage calculated as 0.017–0.5 lb of dry sodium polyacrylate per ton of dry coal.

2. The method of claim 1 wherein the water-in-oil emulsion contains sodium polyacrylate, a hydrophobic solvent, a water-in-oil emulsifier, an oil-in-water activator, and a minor amount of stabilizers.

3. The method of claim 1 wherein the water-in-oil sodium polyacrylate emulsion inverts on usage and contact with water to an oil-in-water emulsion.

4. The method of claim 2 wherein the oil-in-water activator is added separately.

5. A method of increasing the yield of oxidized coal in the range 28×100 mesh (Tyler) undergoing a concentration treatment of froth flotation by using as a flotation promoter in the presence of an activator an invertible water-in-oil emulsion, which is composed of a hydrophobic liquid, a water-in-oil emulsifier, and sodium polyacrylate in a dosage calculated as 0.017–0.5 lb of dry sodium polyacrylate per ton of dry coal, said water-in-oil emulsion conforming to the following formula by weight of the emulsions:

(a) from 5–60% sodium polyacrylate
(b) from 20–90% water
(c) from 5–75% hydrophobic liquid
(d) from 0.1–21% water-in-oil emulsifying agent.

* * * * *